US008136599B2

(12) United States Patent
Alliot

(10) Patent No.: US 8,136,599 B2
(45) Date of Patent: Mar. 20, 2012

(54) MARINE RISER TOWER

(75) Inventor: Vincent Marcel Ghislain Alliot, Rue Clauzel (FR)

(73) Assignee: Acergy France S.A., Suresnes (FR)

( * ) Notice: Subject to any disclaimer, the term of this patent is extended or adjusted under 35 U.S.C. 154(b) by 735 days.

(21) Appl. No.: 11/587,712

(22) PCT Filed: Apr. 26, 2005

(86) PCT No.: PCT/EP2005/005244

§ 371 (c)(1),
(2), (4) Date: Dec. 10, 2007

(87) PCT Pub. No.: WO2005/103436

PCT Pub. Date: Nov. 3, 2005

(65) Prior Publication Data

US 2008/0196899 A1 Aug. 21, 2008

(30) Foreign Application Priority Data

Apr. 27, 2004 (GB) ..... 0409361.3

(51) Int. Cl.
*E21B 17/01* (2006.01)

(52) U.S. Cl. ..... 166/350; 166/345; 166/352; 166/367; 405/224.2

(58) Field of Classification Search ..... 166/367, 166/359, 350–355, 345; 405/224.2–224.4
See application file for complete search history.

(56) References Cited

U.S. PATENT DOCUMENTS 4,182,584 A 1/1980 Panicker et al.
4,279,543 A * 7/1981 Remery ..... 405/224.3
4,388,022 A * 6/1983 Gentry et al. ..... 405/224.3
4,400,110 A 8/1983 Beynet et al.
4,423,984 A * 1/1984 Panicker et al. ..... 405/224.3
4,793,737 A * 12/1988 Shotbolt ..... 405/169
5,007,482 A * 4/1991 Forsyth et al. ..... 166/345
5,288,253 A * 2/1994 Urdshals et al. ..... 441/5
5,427,046 A * 6/1995 Brown et al. ..... 114/230.13
5,615,977 A * 4/1997 Moses et al. ..... 405/195.1
5,957,074 A 9/1999 da Baan et al.

(Continued)

FOREIGN PATENT DOCUMENTS

CA 2437939 4/2004

(Continued)

OTHER PUBLICATIONS

Vincent Alliot et al. "Riser Tower Installation" OTC 14211 (2002) pp. 1-13.

(Continued)

*Primary Examiner* — Thomas Beach
*Assistant Examiner* — Matthew Buck

(57) ABSTRACT

The invention provides a marine riser apparatus (1) for use in the production of hydrocarbons from offshore wells and an associated method of installation of the apparatus at sea. The riser tower comprises rigid pipelines arranged in a riser tower bundle (2) and extending from a wellhead on the seabed (4) to a point below the sea surface where they are connected to flexible jumpers (3) which extend from the tower structure to connect the tower structure to a surface vessel or platform (5). The riser apparatus further comprises a buoyancy device (7) attached to the riser tower bundle, such that the buoyancy device is located above and exerts a buoyancy force on the riser tower, the buoyancy module also supporting an intermediate section of at least one of the jumpers.

39 Claims, 8 Drawing Sheets

U.S. PATENT DOCUMENTS

| | | | | |
|---|---|---|---|---|
| 6,042,303 | A * | 3/2000 | Head | 405/195.1 |
| 6,082,391 | A | 7/2000 | Thiebaud et al. | |
| 6,109,833 | A * | 8/2000 | Savy | 405/195.1 |
| 6,161,619 | A * | 12/2000 | Head | 166/355 |
| 6,206,742 | B1 * | 3/2001 | Bull et al. | 441/1 |
| 6,321,844 | B1 * | 11/2001 | Thiebaud et al. | 166/345 |
| 6,415,828 | B1 * | 7/2002 | Duggal et al. | 141/387 |
| 6,457,536 | B1 * | 10/2002 | Bye et al. | 175/7 |
| 6,558,215 | B1 * | 5/2003 | Boatman | 441/5 |
| 6,595,725 | B1 | 7/2003 | Shotbolt | |
| 6,612,370 | B1 * | 9/2003 | Jahnsen et al. | 166/367 |
| 6,688,348 | B2 * | 2/2004 | Fontenot | 141/387 |
| 6,763,862 | B2 * | 7/2004 | Fontenot et al. | 141/387 |
| 6,837,311 | B1 * | 1/2005 | Sele et al. | 166/353 |
| 6,854,930 | B2 * | 2/2005 | Pionetti | 405/172 |
| 7,367,398 | B2 * | 5/2008 | Chiesa et al. | 166/302 |
| 7,434,624 | B2 * | 10/2008 | Wilson | 166/368 |
| 7,591,316 | B2 * | 9/2009 | Hatton | 166/355 |
| 7,669,660 | B1 * | 3/2010 | Murray et al. | 166/345 |
| 2002/0177375 | A1 * | 11/2002 | Cottrell et al. | 441/5 |
| 2005/0063788 | A1 * | 3/2005 | Clausen | 405/224.2 |
| 2005/0158126 | A1 * | 7/2005 | Luppi | 405/224.2 |

FOREIGN PATENT DOCUMENTS

| | | |
|---|---|---|
| EP | 0251488 | 5/1987 |
| WO | WO 97/22780 | 6/1997 |
| WO | WO 02/094650 | 11/2002 |

OTHER PUBLICATIONS

J.F. Saint Marcoux et al. "Hybrid Riser Tower: from Functional Specification to Cost per Unit Length" DOT XIII Rio de Janeiro Oct. 18, 2001 p. 1-14.

* cited by examiner

MARINE RISER TOWER

The present invention relates to a marine riser tower, of the type used in the transport of hydrocarbon fluids (gas and/or oil) from offshore wells. The riser tower typically includes a number of conduits for the transport of fluids. In particular it relates to apparatus for buoyancy tensioning of offshore deep-water structures. It finds particular application in tensioning a slender, vertical or near-vertical, bottom-anchored, submarine structure, such as a riser or a bundle of risers (which may, or may not, include a structural member) or an umbilical.

Tensioning is the act of ensuring that a marine structure doesn't experience excursions from its nominal upright position that would fall outside the acceptable limits, even in extreme weather conditions, the said limits being possibly defined with reference to the occurring sea state. There should always be sufficient tension to ensure stability, no matter the weight of the structure and the weight of the pipelines/risers hanging off the structure.

The structure may form part of a so-called hybrid riser, having an upper and/or lower portions ("jumpers") made of flexible conduit. U.S. Pat. No. 6,082,391 (Stolt/Doris) proposes a particular Hybrid Riser Tower consisting of an empty central core, supporting a bundle of riser pipes, some used for oil production some used for water and gas injection. This type of tower has been developed and deployed for example in the Girassol field off Angola. Insulating material in the form of syntactic foam blocks surrounds the core and the pipes and separates the hot and cold fluid conduits. Further background has been published in papers "Hybrid Riser Tower: from Functional Specification to Cost per Unit Length" by J-F Saint-Marcoux and M Rochereau, DOT XIII Rio de Janeiro, 18 Oct. 2001 and "Girassol Field Development—Total Elf Fina—Riser Tower Installation" OTC 2002 number 14211 by Vincent Alliot & Olivier Carré. Updated versions of such risers have been proposed in WO 02/053869 A1, from which it is known to use a vertical riser bundle where the production lines are individually insulated and where the syntactic foam function is buoyancy only.

It is also known, on the Wanaea & Cossack field in Australia, for Woodside, for example, to have flexible riser jumpers each supported by buoyancy foam elements which are clamped to each flexible jumper. Buoyancy foam suppliers such as the CRP Group have developed clamps to attach the buoyancy elements on flexible and umbilical lines.

However, such a system presents some drawbacks: Firstly, there is the substantial cost of individual buoyancy elements and clamps (made in titanium). There is no spare buoyancy, unless there are some spare foam buoyancy elements and associated removable ballast weight placed on the riser tower structure. Furthermore it is necessary to provide sufficient buoyancy along the riser bundle to compensate for the weight of the bundle with the pipe full of water. Also, the buoyancy elements are required to be added to the jumpers on board the vessel and consequently the installation procedure to connect the positively buoyant flexible jumper onto the tower structure is complicated and time consuming. There is also the potential problem of riser jumper clashes which requires the separation of the riser jumper connections at the riser tower top. This requires the need to enlarge the structure at the riser tower top which could potentially create fatigue problems at the interface with the bundle. This increase in the vertical bundle diameter would degrade the dynamic behaviour of the riser tower when it is surface towed.

The present invention attempts to alleviate some or all of such drawbacks.

In a first aspect of the invention there is provided a marine riser apparatus for use in the production of hydrocarbons from offshore wells, said riser tower comprising one or more rigid conduits supported in a tower structure and extending from a connecting structure on the seabed to a point below the sea surface and wherein there is provided one or more flexible conduits extending from said tower structure to connect said tower structure to a surface structure, and wherein there is farther provided a buoyancy device attached to said tower structure, such that said buoyancy device is located above and exerts a buoyancy force on said riser tower and wherein said buoyancy device also supports an intermediate section of at least one of said one or more flexible conduits.

Said tower structure may comprise a plurality of rigid conduits arranged around a structural core. Alternatively some conduits may be located inside a tubular core. Preferably there is also provided the same number of flexible conduits as rigid conduits such that a flexible conduit connects each rigid conduit to the surface structure.

Said buoyancy device may comprise a tank, such as a steel pressure tank, or syntactic foam elements, or both and may be attached to said tower structure by at least one tether. Preferably two tethers are used. Said buoyancy device may initially be ballasted to provide spare buoyancy when required.

Preferably, said buoyancy device also incorporates a support device for the support of said flexible conduits. Said support device may be provided with guides for each flexible conduit in order to minimise clashing. The guides may be replaced by clamping devices combined with bend stiffeners mounted on the flexible conduit structure to optimize the breath of the support device and improve the dynamic response of the structure under the pulling action of the flexible jumpers.

This configuration allows the connection of the flexible jumpers from above directly to the tower structure with or without any intermediate pieces Therefore there is no need for the gooseneck which simplifies the installation.

Preferably said buoyancy force is exerted on the riser through a combination of said at least one tether and said flexible conduits. In one embodiment there is further provided adjustment means to enable adjustment of the tension imparted on said tower structure by said flexible conduits and/or the tether(s). This is particularly preferable since compression loads should not be exerted on the flexible conduits, and the provision of adjustment means which allow the adjustment of the tension of the flexible lines once connected to the tower structure helps to prevent this. There may be provided separate adjustment means for each flexible conduit and/or for each tether. Said adjustment means may be provided on the support device and may consist of hydraulic or mechanical jacks. In an alternative embodiment the flexible conduits may be tensioned by inducing a tilt in a top part of the tower structure by selective ballasting of the buoyancy device. The buoyancy device may comprise at least two tanks or a tank with at least two chambers and each of the tanks/chambers may be selectively ballasted relative to each other, or one tank/chamber may be ballasted only.

The tower structure may optionally further comprise top buoyancy. This may be in the form of a steel tank or foam located around the core at the top of the tower structure. There also may be, additionally or in place of the top buoyancy, buoyancy located substantially along the full length of the tower structure, or alternatively at strategic points along its length.

In a further aspect of the invention there is provided a method of installing a marine riser apparatus according to a first aspect of the invention comprising:

towing a tower structure to the installation site, said tower structure comprising one or more rigid conduits having a buoyancy device and a support device mounted to a first end;

upending the tower structure assembly by sinking a second end of said tower structure to the seabed;

anchoring the tower structure to the seabed;

deballasting the buoyancy device;

directly connecting one or more flexible conduits to the top of the tower structure;

passing a first end of at least one of said one or more flexible conduits over the support device; and attaching a second end of flexible conduit to a surface structure Other embodiments of this method are as disclosed in the appended claims.

BRIEF DESCRIPTION OF THE DRAWINGS

Embodiments of the invention will now be described, by way of example only, by reference to the accompanying drawings, in which.

DETAILED DESCRIPTION OF THE EMBODIMENTS

Figure 1:
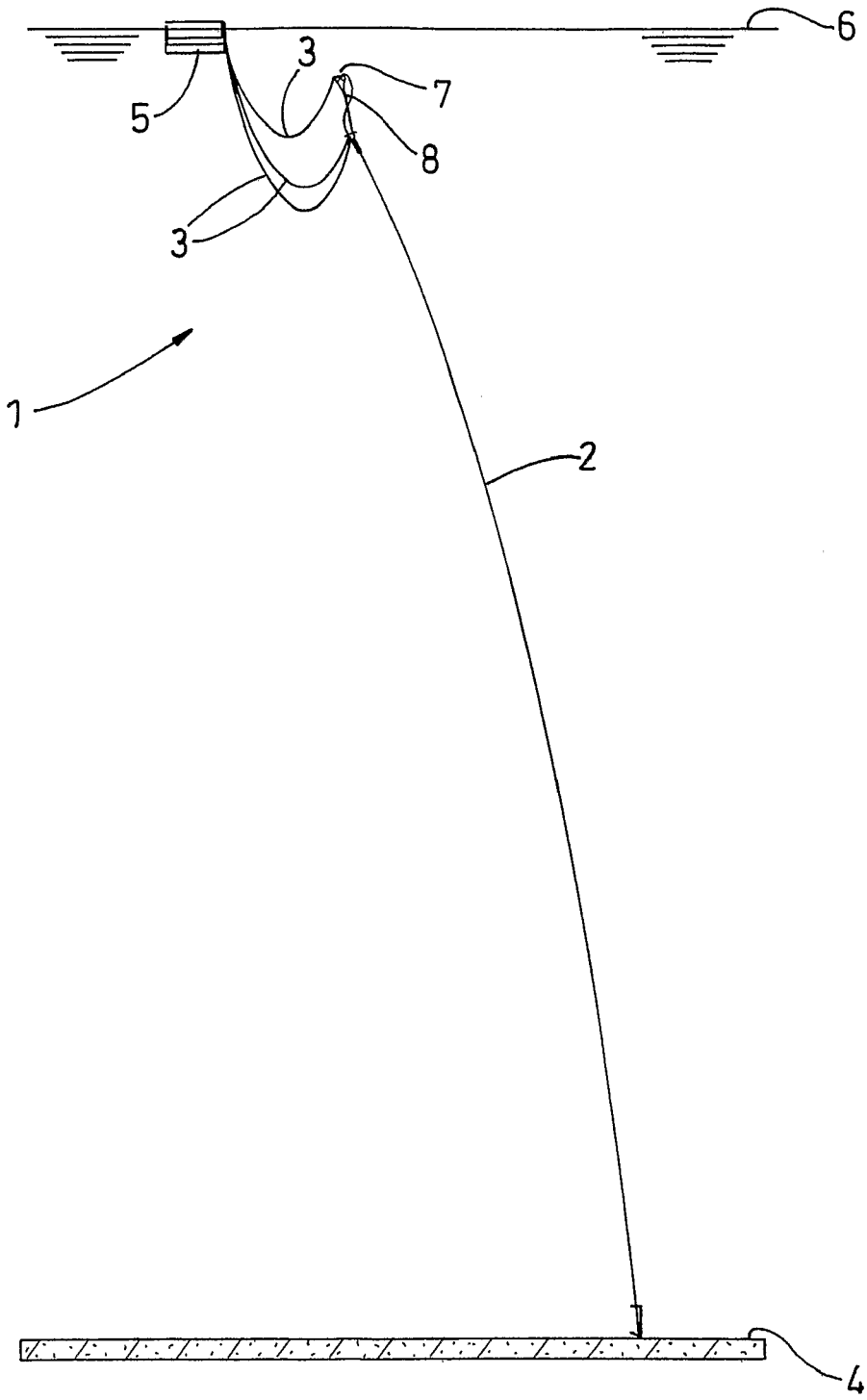
FIG. 1 shows a hybrid riser tower according to an aspect of the invention.

FIG. 1 shows a hybrid riser tower 1 which consists of a substantially rigid riser tower bundle 2 and a number of flexible pipelines or "jumpers" 3*a*, 3*b*. The bottom end of the riser tower bundle 2 is connected to a wellhead (not shown) on the seabed 4. The jumpers 3*a*, 3*b* connect the top of the riser tower bundle 2 to a Floating Production, Storage and Offloading (FPSO) vessel 5 on the sea surface 6. At the top of the riser tower bundle 2 is a buoyancy tank/support arch 7 which also doubles as a support arch.

This buoyancy tank/support arch 7 is attached to the top of the riser tower bundle 2 by tethers 8. A number of the jumpers 3*a* rest on the buoyancy tank/support arch 7, depending on the number of riser lines. If there are only a few then all may rest on the arch 7, however if there are many, it may be difficult to accommodate all the jumpers 3*a* 3*b* on the support arch and it may be appropriate to have the smaller lines 3*b* kept in a simple catenary.

In use, the riser tower bundle 2 extends approximately vertically from the well head and is tensioned via the tethers 8 by the buoyancy force acting on the tank 7. There may also be foam provided along the length of the riser tower bundle 2, in order to aid buoyancy as well as foam or steel tank top riser buoyancy on the top of the bundle 1 itself. The buoyancy tank/support arch 7 is designed to be ballasted and consequently can be de-ballasted to provide adequate spare buoyancy when required.

Figure 2:
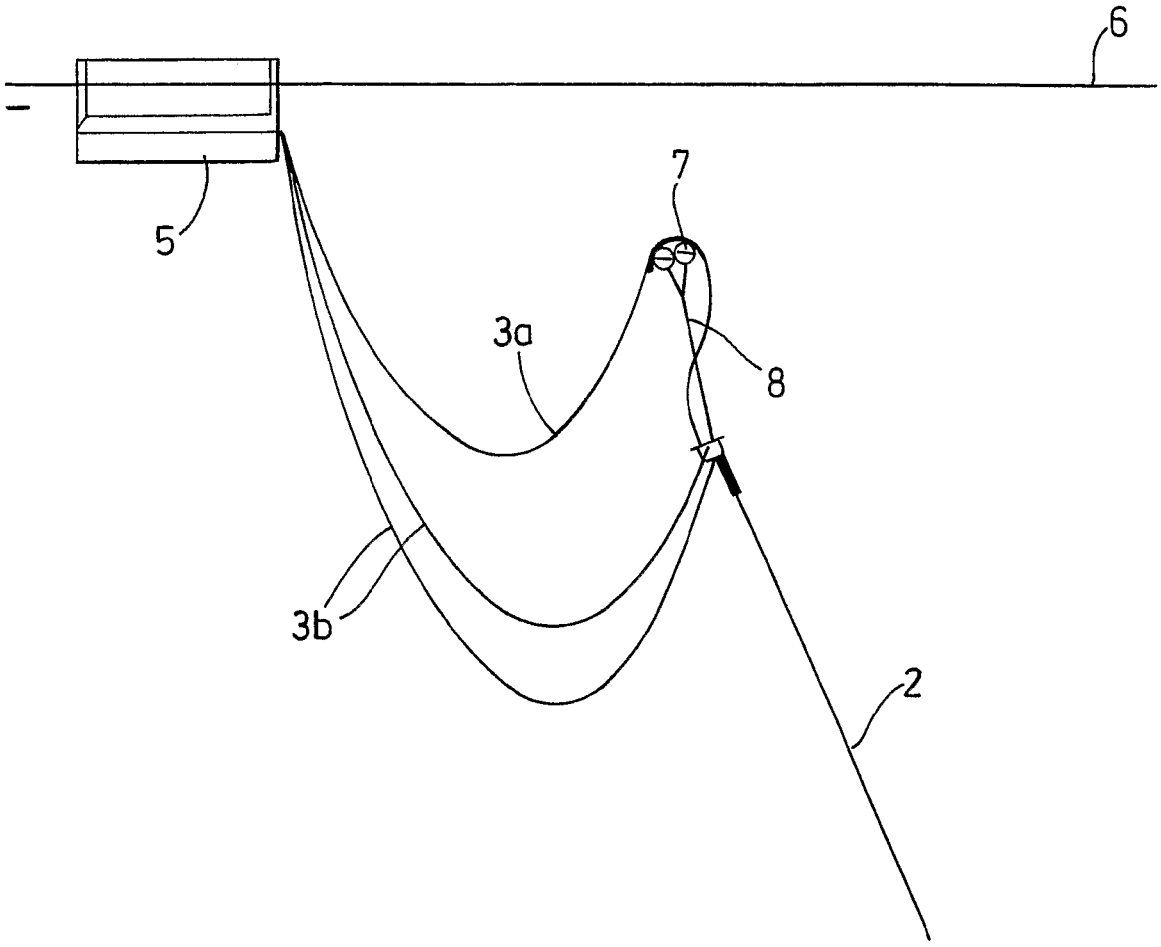
FIG. 2 shows part of the riser tower of FIG. 1 in more detail.
Figure 3:
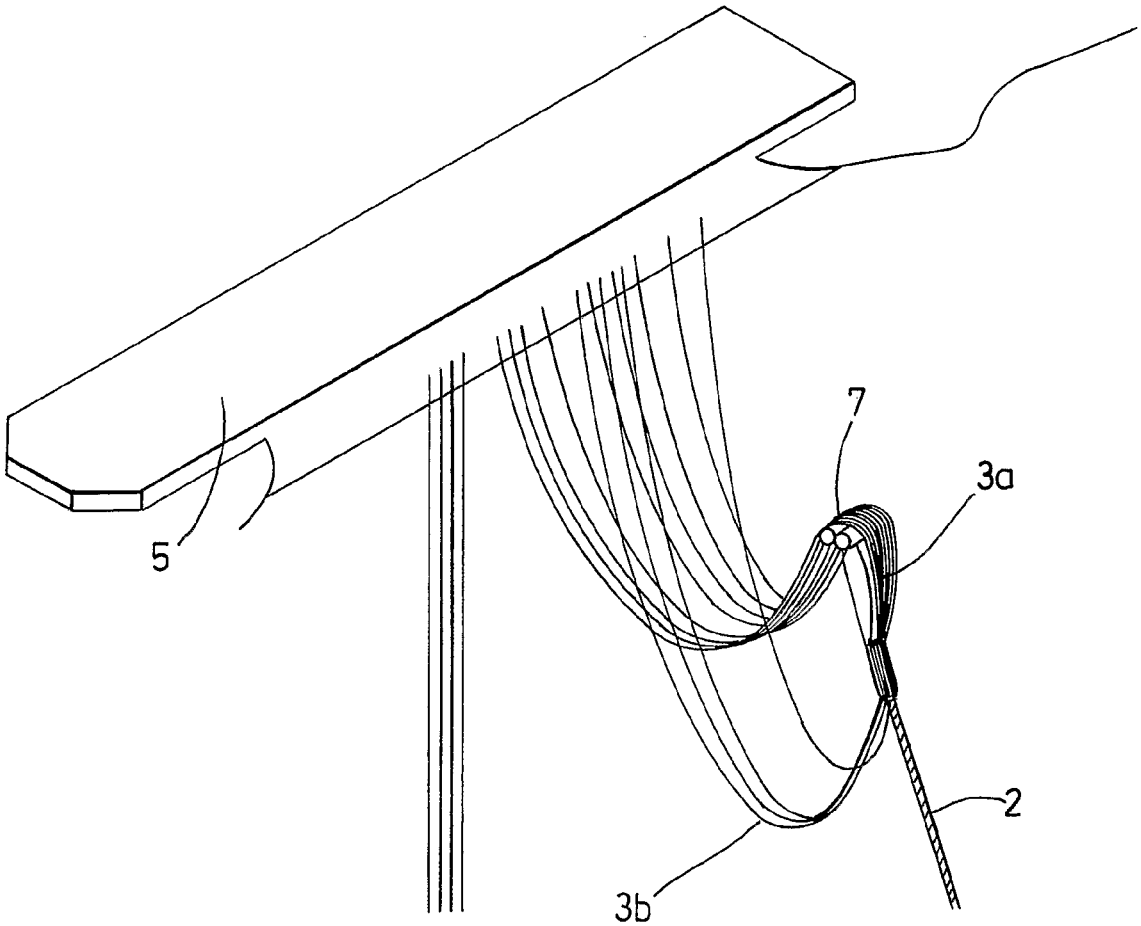
FIG. 3 shows the arrangement of FIG. 2 in perspective.

FIG. 2 shows the arrangement connecting the top of the riser tower bundle 2 to the FPSO 5 in more detail. FIG. 3 shows the arrangement of FIG. 2 in perspective, and shows that the majority of the jumpers 3*a* are supported by the tank/support arch 7.

Figure 4:
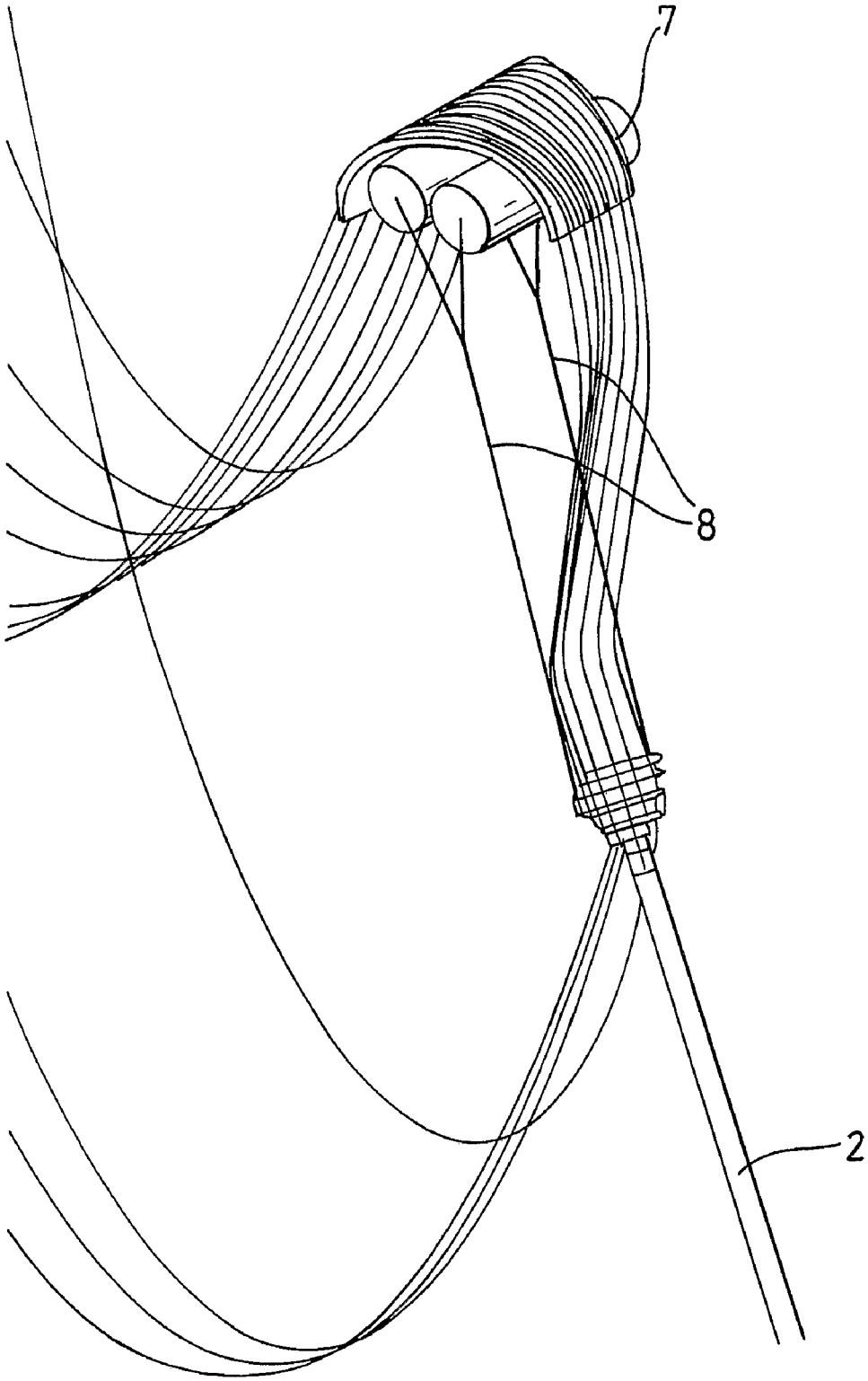
FIG. 4 shows part of the arrangement of FIGS. 2 and 3 in more detail.
Figure 5A:
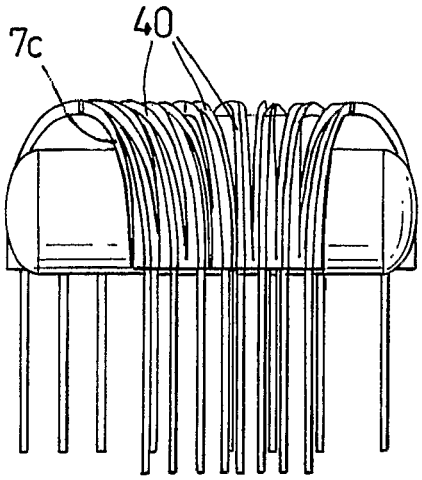
FIGS. 5*a*-5*d* shows the support arch/buoyancy tank from the front, side, top and isometric views respectively.
Figure 5B:
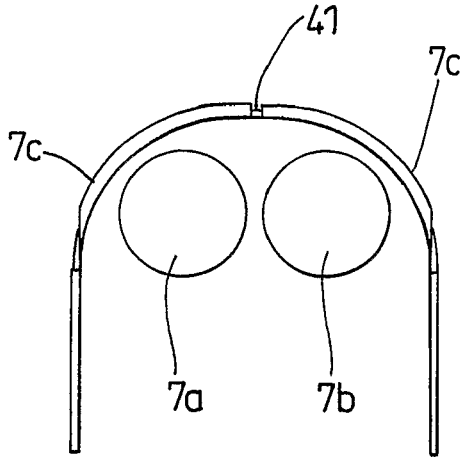
Figure 5C:
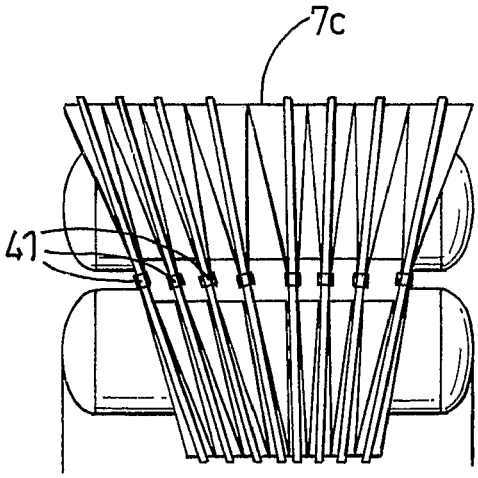
Figure 5D:
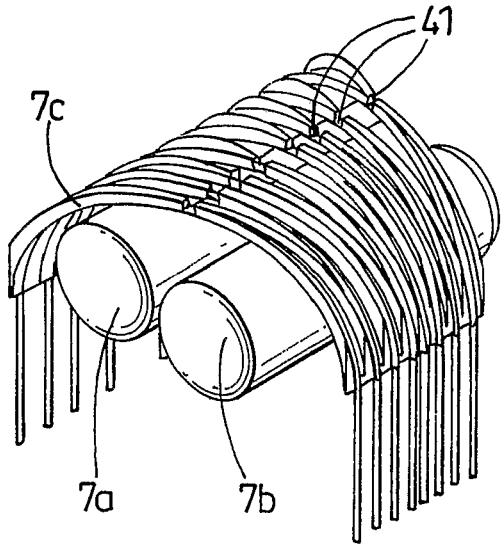

FIG. 4 shows the arrangement connecting the top of the riser tower bundle 2 to the FPSO 5, as depicted in FIG. 3, in more detail. This shows the top of the riser tower bundle 2, including the support arch/buoyancy tank 7.

The buoyancy tank/support arch 7, in this embodiment, also incorporates devices 41 to allow independent tension adjustment of each jumper and tether. This support arch tension adjustment of the jumpers and tethers allows optimisation of the way the top tension is transferred to the riser tower bundle 2. It also presents an additional reliability in that the buoyancy tank/support arch 7 is connected to the riser tower by several mechanical links and potentially the role of the vertical tethers 8 can be minimised in operating conditions throughout the design life of the system.

FIGS. 5*a*-5*d* shows the buoyancy tank/support arch 7 in greater detail from the front, side, top and isometric views respectively. From this it can be clearly seen that the tank/support arch 7 of this embodiment actually comprises two steel tanks 7*a*, 7*b* and support arch 7*c*. Jumper guides 40 are incorporated on the arch 7*c* which control the jumpers 3*a* and prevent them from clashing. The jumpers 3*a* are attached to the top of the riser tower bundle 2 and each one is fed over a jumper guide 40 of the buoyancy tank/support arch 7 which splay out, keeping the jumpers 3*a* from one another between the buoyancy tank/support arch 7 and the FPSO 5. Each one of the guides has an adjustment device 41 mounted to it.

Figure 6:
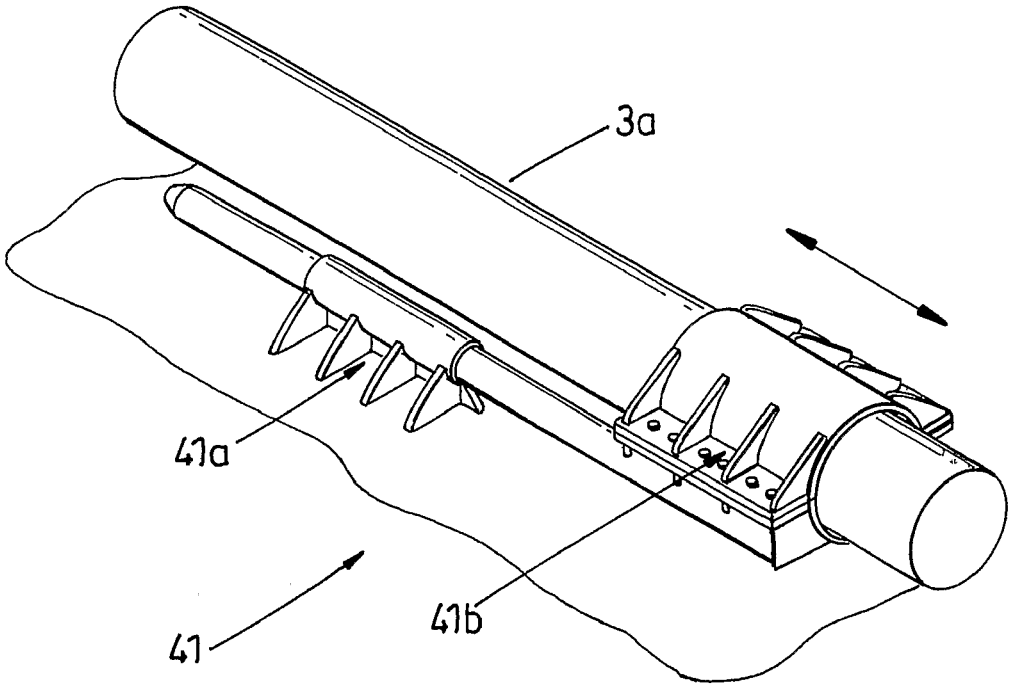
FIG. 6 shows in detail adjustment means suitable for adjusting the tension of the jumper conduits.

FIG. 6 shows one of the adjustment devices 41 in more detail. This is in the form of a mechanical of hydraulic jacking device, formed in two interconnected parts 41*a* and 41*b* which move laterally relative to one another. One part 41*a* is fixed to the support arch 7*a* and one part attached to the jumper 3*a*. It can be seen that adjusting this device adjusts the tension in the jumpers 3*a*.

Figure 7:
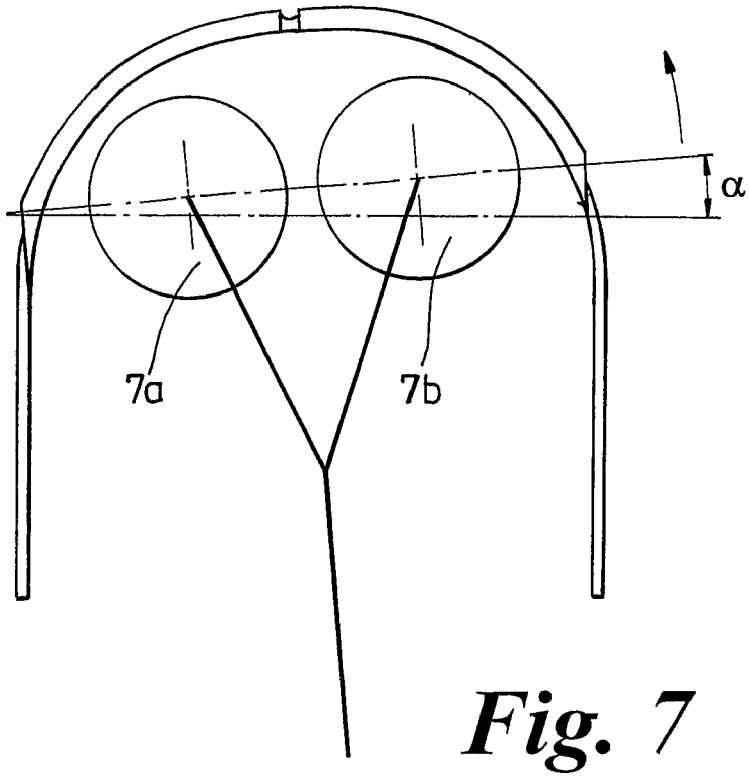
FIG. 7 shows an alternative way of tensioning the jumper conduits.

An alternative arrangement to adjust the tension in the jumpers in depicted in FIG. 7. This shows an arrangement whereby the buoyancy tank 7*a* on the FPSO side of the tower is ballasted and whereby the buoyancy tank 7*b* on the supply side is not. This ensures that the jumpers are kept in tension. The amount of tension can be adjusted by changing the angle $\alpha$ by changing the relative buoyancies of the tanks. This can be done by ballasting/unballasting tank 7*a* or alternatively also ballasting tank 7*b*. Ballasting is simply achieved using seawater.

Figure 8:
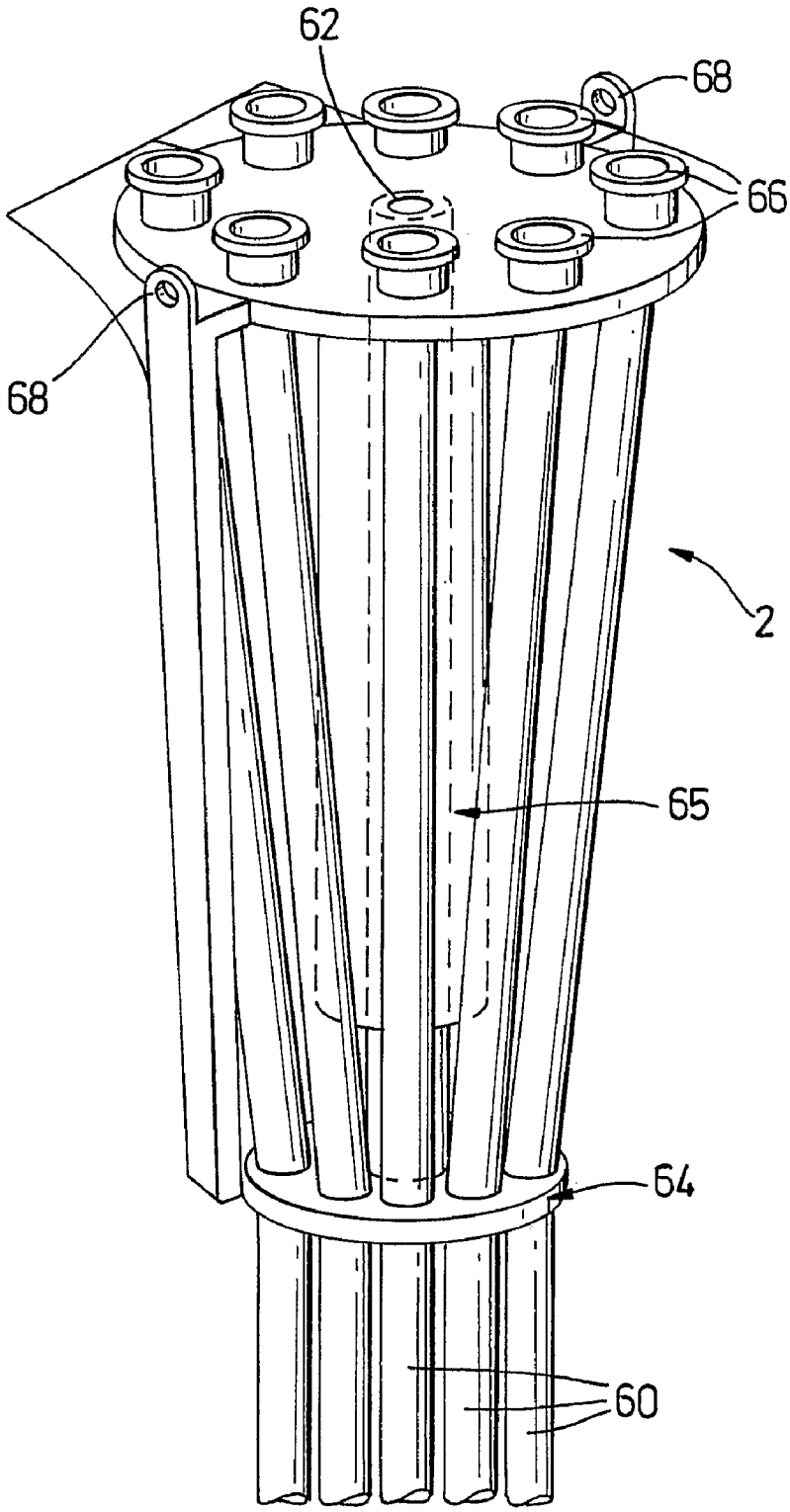
FIG. 8 shows the top of the riser tower bundle prior to connection of the tethers and flexible jumpers.

FIG. 8 shows the top of the riser tower bundle without the connections to the jumpers and tethers. This shows a number of rigid pipelines 60 arranged around a core pipe 62. The pipelines 60 and core pipe 62 are held relative to each other by a main suspension plate 64. At the top of each rigid pipe 60 is an attachment for a flexible jumper 66 and there is also provided tether attachments 68. Around the core 62 is top riser buoyancy 65, which may take the form of foam (e.g. syntactic foam) or a steel tank. Further buoyancy may be located along the length of the riser tower bundle. In this case some of the buoyancy along the bundle can be transferred to the support arch tank if the tower is installed with the pipe empty, and then deballasted after the upending operation.

A particular advantage of this concept is that it allows the installation of both the riser vertical bundle and buoyancy device/support arch in one single operation. The buoyancy device/support arch, the riser bundle and tether line(s) are assembled together at the fabrication yard prior to surface tow operation. The installation operation is then based on the operation as used on the Girassol field (refer to OTC 2002 number 14211 "Girassol Field Development—Total Elf Fina—Riser Tower Installation") and can be described as follows:

1. Confirm riser bundle and support arch/buoyancy device are correctly connected through the tether line(s).
2. Set up towlines at each extremity of riser tower,
3. The towing operation can be achieved either with the top riser buoyancy and the buoyancy tank leading or following.
4. The riser tower is towed to the installation site, either on the surface, partially submerged or totally submerged, the latter option by sinking the riser tower extremities by means of ballast chain or deadweight incorporated to the towline arrangement.
5. When the towing convoy has arrived at the installation site the riser tower assembly is upended by sinking the bottom extremity to the seabed.
6. The riser tower is then stabbed onto its anchor base by means of a subsea connector and pulling sheaves pre-installed on the anchor base.
7. Towlines are disconnected at each extremity.
8. The buoyancy device is deballasted to provide more buoyancy and consequently increasing vertical tension on the riser tower structure.
9. The flexible jumpers are deployed vertically and directly connected to the top of the riser tower bundle either manually, with the assistance of divers, or without divers and using special connectors.
10. Each flexible jumper is then passed over the arch support through the guiding or clamping devices.
11. The other extremity is then pulled through I or J tubes and a hang-off device installed on the FPSO.

Figure 9:
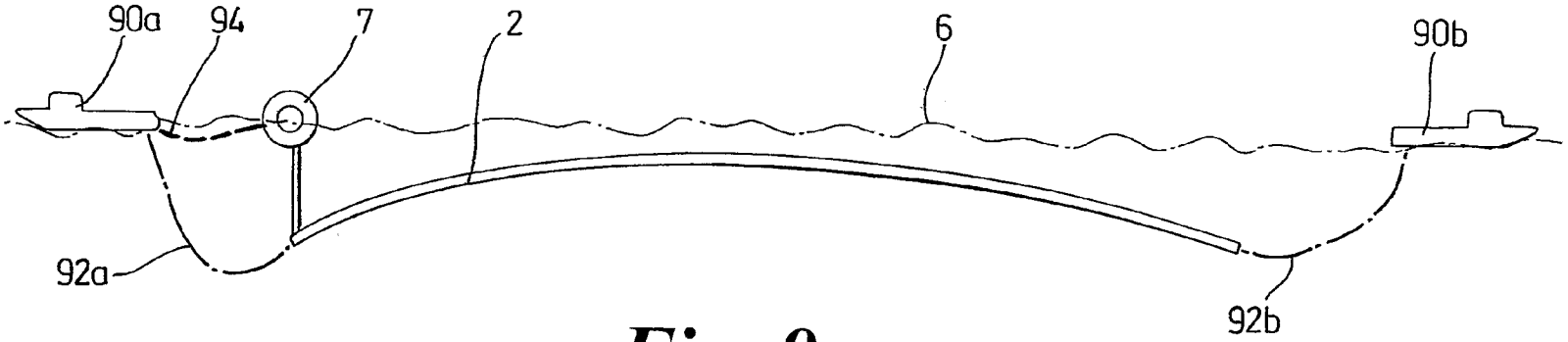
FIG. 9 shows the riser tower bundle being towed to the installation site.
Figure 10:
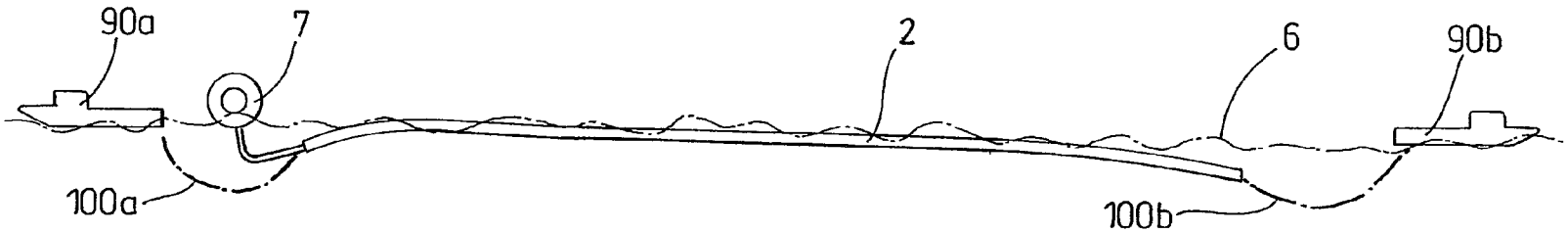
FIG. 10 also shows the riser tower bundle being towed to the installation site.

FIGS. 9 and 10 show the riser tower bundle being towed to the installation site. They both show the riser bundle 2 attached at either end to tugs 90*a*, 90*b*, with buoyancy tank/support arch 7 attached. In FIG. 10 the riser tower bundle 2 is being towed submerged below the sea surface 6, and is attached to the tugs by ballasted towlines 92*a*, 92*b*. There is also provided a further towline or control 94 for the buoyancy device 7. In FIG. 10, the riser tower bundle 2 is being towed unsubmerged and therefore attached to the tugs by unballasted towlines 100*a*, 100*b*.

The invention is not limited to the above described embodiments, and other embodiments can be envisaged without departing from the spirit and scope of the invention. Namely, other forms of adjustment means or other methods than those described may be used to keep the flexible conduits tensioned. Also the steps of the installation method may be achieved in a different order where appropriate.

The invention claimed is:

1. A marine riser apparatus for use in the production of hydrocarbons from offshore wells, wherein said riser apparatus comprises:

a riser tower comprising a substantially rigid bundle of rigid conduits, the riser tower having a first end at which the rigid conduits are connected to one or more flexible conduits and having a second end from which the rigid conduits are adapted to extend to connecting structures on the sea bed;

a buoyancy device tethered to the first end of the riser tower and adapted to be located above the riser tower when the riser tower and the buoyancy device are underneath a sea surface;

wherein an intermediate section of at least one of the flexible conduits is supported by the buoyancy device.

2. A marine riser apparatus as claimed in claim 1, wherein there are a plurality of flexible conduits, and wherein at least one of the flexible conduits is supported by the buoyancy device whereas at least one other of the flexible conduits is not supported by the buoyancy device.

3. A marine riser apparatus as claimed in claim 1, wherein said substantially rigid bundle comprises a plurality of rigid conduits arranged around a structural core.

4. A marine riser apparatus as claimed in claim 1, wherein said substantially rigid bundle comprises a plurality of rigid conduits and some of said conduits are located inside a tubular core.

5. A marine riser apparatus as claimed in claim 1, wherein there are the same number of flexible conduits as rigid conduits disposed such that a flexible conduit connects each rigid conduit to the surface structure.

6. A marine riser apparatus as claimed in claim 1, wherein said buoyancy device comprises a tank.

7. A marine riser apparatus as claimed in claim 6, wherein said tank comprises a steel pressure tank.

8. A marine riser apparatus as claimed in claim 1, further comprising syntactic foam elements to provide buoyancy.

9. A marine riser apparatus as claimed in claim 1, wherein two tethers are used to tether said buoyancy device to said riser tower.

10. A marine riser apparatus as claimed in claim 9, wherein there is provided a separate adjustment mechanism for each tether.

11. A marine riser apparatus as claimed in claim 1, wherein said buoyancy force is exerted on the riser through a combination of said at least one tether and said flexible conduits.

12. A marine riser apparatus as claimed in claim 11, wherein there is further provided an adjustment mechanism to enable adjustment of the tension imparted on said riser tower by said flexible conduits, the at least one tether, or both.

13. A marine riser apparatus as claimed in claim 12, wherein there is provided a separate adjustment mechanism for each flexible conduit.

14. A marine riser apparatus as claimed in claim 12, wherein said adjustment mechanism comprises a hydraulic jack or a mechanical jack.

15. A marine riser apparatus as claimed in claim 1, wherein the flexible conduits are tensioned by inducing a tilt in a top part of the riser tower by selective ballasting of the buoyancy device.

16. A marine riser apparatus as claimed in claim 15, wherein the buoyancy device comprises at least two tanks, or a tank with at least two chambers, and each of the tanks or chambers is selectively ballasted relative to the other.

17. A marine riser apparatus as claimed in claim 15, wherein the buoyancy device comprises at least two tanks, or a tank with at least two chambers, and only one tank or chamber is ballasted.

18. A marine riser apparatus as claimed in claim 1, wherein said buoyancy device is initially ballasted to provide spare buoyancy when required.

19. A marine riser apparatus as claimed in claim 1, wherein said buoyancy device also incorporates a support device for the support of said flexible conduits.

20. A marine riser apparatus as claimed in claim 19, wherein said support device is provided with guides for each flexible conduit supported in order to minimize clashing.

21. A marine riser apparatus as claimed in claim 19, wherein said support device comprises clamping devices combined with bend stiffeners mounted on the flexible conduit structure.

22. A marine riser apparatus as claimed in claim 1, wherein the riser tower further comprises top buoyancy.

23. A marine riser apparatus as claimed in claim 22, wherein said top buoyancy comprises either or both of a steel tank and foam located around a core at the top of the riser tower.

24. A marine riser apparatus as claimed in claim 1, wherein there is provided buoyancy located substantially along a full length of the riser tower.

25. A marine riser apparatus as claimed in claim 1, wherein there is provided buoyancy located at strategic points along a length of the riser tower.

26. A method of installing a marine riser apparatus comprising:

towing a riser tower to an installation site, said riser tower comprising a substantially rigid bundle of rigid conduits, the riser tower having a first end and a second end, wherein the riser tower is tethered at its first end to a buoyancy device;

upending the riser tower by sinking a second end of said riser tower structure to the seabed at the installation site;

anchoring the tower structure to the seabed;

deballasting the buoyancy device;

connecting one or more flexible conduits to the top of the tower structure;

passing a first end of at least one of said one or more flexible conduits over the buoyancy device; and attaching a second end of said at least one or more flexible conduits to a surface structure.

27. A method as claimed in claim 26, comprising confirming that said riser tower and said buoyancy device are correctly connected through one or more tether lines.

28. A method as claimed in claim 26, wherein the towing operation is achieved with the buoyancy device leading.

29. A method as claimed in claim 26, wherein the towing operation is achieved with the buoyancy device following.

30. A method as claimed in claim 26, wherein said riser tower is towed to said installation site on the water's surface.

31. A method as claimed claim 26, wherein said riser tower is towed to said installation site either partially submerged or totally submerged.

32. A method as claimed in claim 31, wherein said riser tower is partially or totally submerged by sinking the first end and the second end of the riser tower structure by means of ballast chain or deadweight incorporated to the towline arrangement.

33. A method as claimed in claim 26, wherein said riser tower comprises guiding or clamping devices, and wherein the method comprises the additional step of guiding the one or more flexible conduits through the guiding or clamping devices.

34. A method as claimed in claim 26, wherein second ends of said one or more flexible conduits are then pulled through I or J tubes and a hang-off device installed to said surface structure.

35. A method as claimed in claim 26, wherein lines towing the riser tower are disconnected after anchoring of the riser tower to the seabed.

36. A method as claimed in claim 26, wherein said riser tower is anchored to an anchor base on the seabed.

37. A method as claimed in claim 36, wherein the riser tower is anchored to said anchor base by means of a subsea connector and pulling sheaves pre-installed on the anchor base.

38. A method as claimed in claim 26, wherein said one or more flexible conduits are connected to the riser tower manually.

39. A method as claimed in claim 26, wherein said one or more flexible conduits are connected to the riser tower remotely using special connectors.

* * * * *